United States Patent [19]

Lathers

[11] Patent Number: 4,813,514

[45] Date of Patent: Mar. 21, 1989

[54] ACCESS LADDER FOR PLEASURE WATERCRAFT

[75] Inventor: Michael W. Lathers, Metamora, Mich.

[73] Assignee: Outboard Marine Corporation, Waukegan, Ill.

[21] Appl. No.: 178,592

[22] Filed: Apr. 7, 1988

[51] Int. Cl.[4] ..... B63B 29/20; E06C 5/24

[52] U.S. Cl. ..... 182/97; 182/86; 182/91; 114/362

[58] Field of Search ..... 182/91, 97, 86; 114/362

[56] References Cited

U.S. PATENT DOCUMENTS

| | | | |
|---|---|---|---|
| 2,967,584 | 1/1961 | Westerlund | 182/97 |
| 2,971,601 | 2/1961 | Fortune | 182/97 |
| 3,232,376 | 2/1966 | Lucas | 182/97 |
| 3,606,934 | 9/1971 | Johansen | 182/97 |
| 3,973,646 | 8/1976 | Martinez | 182/97 |
| 4,556,125 | 12/1985 | Johnson | 182/91 |
| 4,712,503 | 12/1987 | Ritten | 182/86 |
| 4,722,419 | 2/1988 | Hoszowski | 182/91 |
| 4,726,317 | 2/1988 | Ritten | 182/91 |

*Primary Examiner*—Reinaldo P. Machado

*Attorney, Agent, or Firm*—Michael, Best & Friedrich

[57] ABSTRACT

A marine installation comprising a watercraft having a generally horizontal surface, and a ladder assembly comprising a ladder frame including spaced, parallel side bars, and spaced, parallel rungs extending between the side bars, and a mechanism for mounting the ladder frame on the horizontal surface such that the ladder frame is movable between a storage position wherein the ladder frame is located above the surface and an operating position wherein the ladder frame extends below the surface.

20 Claims, 1 Drawing Sheet

ACCESS LADDER FOR PLEASURE WATERCRAFT

BACKGROUND OF THE INVENTION

The invention relates to ladders used for boarding pleasure boats from the water.

Pleasure watercraft such as power cruisers or sailing vessels quite frequently have an over-the-transom ladder which hooks on to the back of the transom panel at the stern of the vessel. These ladders must be stored above the vessel, and this creates a space problem. In addition, in rough weather, it is important that these ladders be secured so they are not shifting about.

SUMMARY OF THE INVENTION

The invention provides an access ladder assembly for a watercraft having a generally horizontal surface, the assembly comprising a ladder frame including spaced, parallel side bars, and spaced, parallel rungs extending between the side bars, and means for mounting the ladder frame on the horizontal surface such that the ladder frame is movable between a storage position wherein the ladder frame is located above the surface and the side bars define a generally vertical storage plane, and an operating position wherein the ladder frame extends below the surface and the side bars define a generally vertical operating plane intersecting the storage plane.

In one embodiment, the side bars and the rungs define a first plane, and the mounting means includes a mounting frame connected to the side bars and defining a second plane generally perpendicular to the first plane, and means for connecting the mounting frame to the surface for pivotal movement relative thereto about a generally horizontal axis.

In one embodiment, the mounting frame includes a first leg member having one end connected to one of the side bars and an opposite end pivotably connected to the surface, and a second leg member having one end connected to the other of the side bars and an opposite end pivotably connected to the surface.

In one embodiment, the first leg member is disposed at an angle of approximately 45 degrees relative to the first plane, and the second leg member includes a first portion connected to the other of the side bars and extending generally perpendicular to the first plane, and a second portion generally parallel to the first leg member.

In one embodiment, the operating plane is generally perpendicular to the storage plane.

In one embodiment, the mounting means includes means for connecting the ladder frame to the surface for pivotal movement relative thereto about a generally horizontal axis located in a generally vertical plane bisecting the storage and operating planes.

The invention also provides an access ladder assembly for a watercraft having a generally horizontal surface, the ladder assembly comprising a ladder frame including spaced, parallel side bars, and spaced, parallel rungs extending between the side bars, the side bars and the rungs defining a first plane, and means for mounting the ladder frame on the horizontal surface such that the ladder frame is movable between a storage position wherein the ladder frame is located above the surface and an operating position wherein the ladder frame extends below the surface, the mounting means including a mounting frame connected to the ladder frame and defining a second plane generally perpendicular to the first plane, the mounting frame including a first 1*e* member disposed at an angle of approximately 45 degrees relative to the first plane and having one end connected to one of the side bars and an opposite end adapted to be pivotably connected to the surface, and a second leg member having one end connected to the other of the side bars and an opposite end adapted to be pivotably connected to the surface, the second leg member including a first portion connected to the other of the side bars and extending generally perpendicular to the first plane, and a second portion generally parallel to the first leg member.

A principal feature of the invention is the provision of an access ladder which is easily stored against a side wall of the vessel but which can quickly be positioned for use by persons desiring to board. The adder can be permanently secured and readily moved from an out-of-the-way position to an operative position. Briefly, this is accomplished by a ladder with a relatively thin transverse thickness having support legs of varying lengths and angled shapes so that the ladder may be shifted from a vertical position against a panel of a boat to an operative position in a plane transverse to the panel and below a horizontal platform on which the ladder is pivotally mounted.

Other objects and features of the invention will be set forth in the following description and claims in which the principles of the invention are set forth together with details to enable persons skilled in the art to practice the invention, all in connection with the best mode presently contemplated for the invention.

Figure 1:
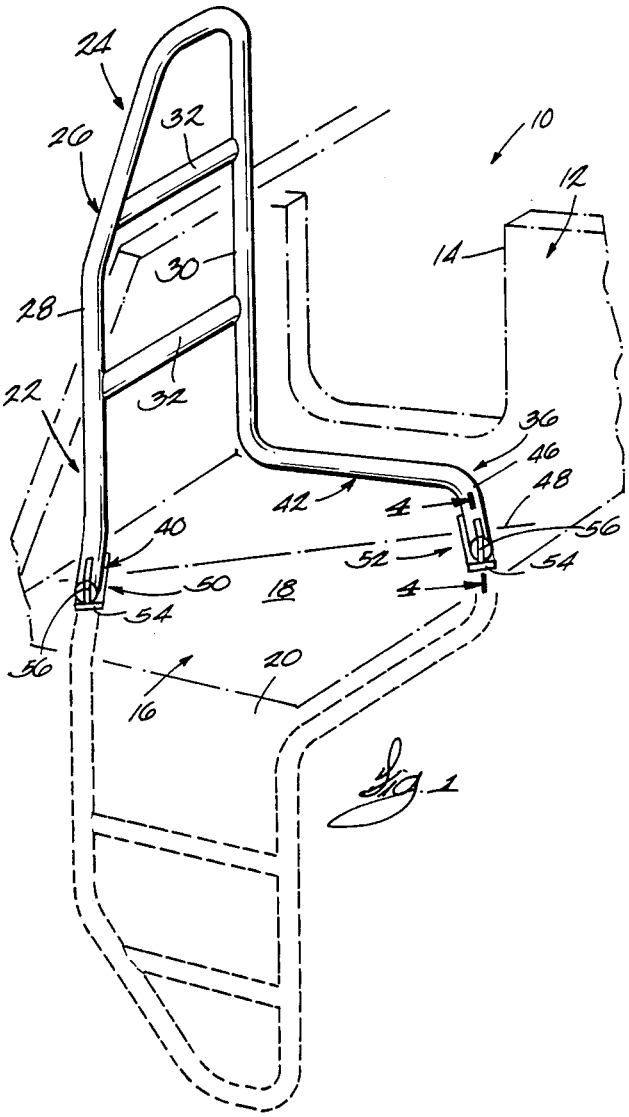
FIG. 1 is a perspective view of an access ladder in a storage position in full lines and in an operating position in dotted lines.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

A watercraft or boat 10 embodying the invention is illustrated in the drawings. As shown in FIG. 1, the boat 10 includes a generally vertical transom panel 12 having therein an opening or recess 14 that provides access to the interior of the boat 10, a generally horizontal transom platform 16 extending outwardly from the transom panel 12 and having a generally horizontal upper surface 18 and a rearward end 20, and a generally vertical wall panel 22 connecting the transom panel 12 and the transom platform 16 and extending generally perpendicular to both the transom panel 12 and the transom platform 16.

Figure 2:
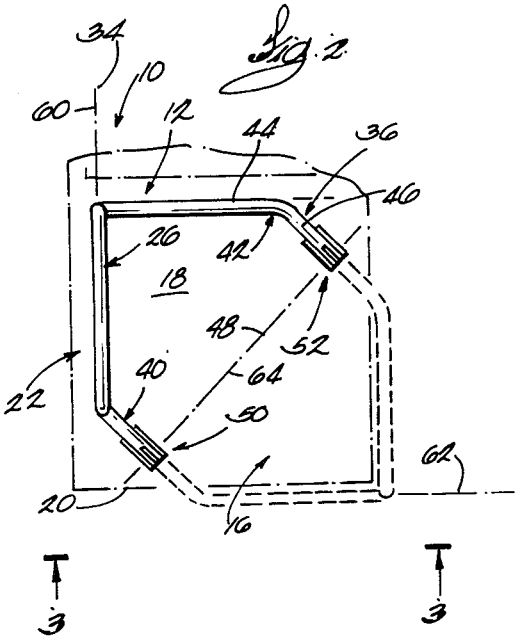
FIG. 2 is a plan view showing the ladder in the storage position in full lines and in the operating position in dotted lines.
Figure 3:
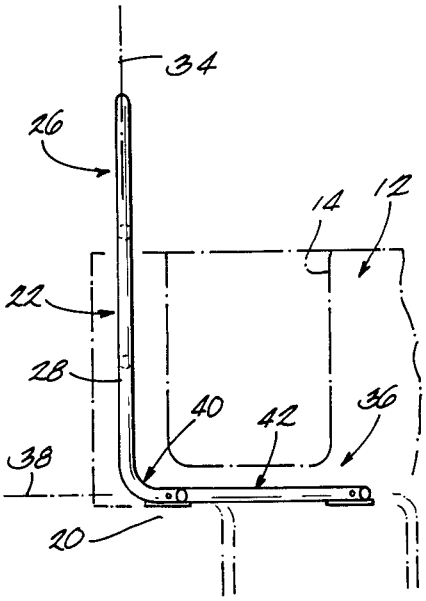
FIG. 3 s an elevational view taken along line 3—3 in FIG. 2 and showing the storage position in full lines and the operating position in dotted lines.
Figure 4:
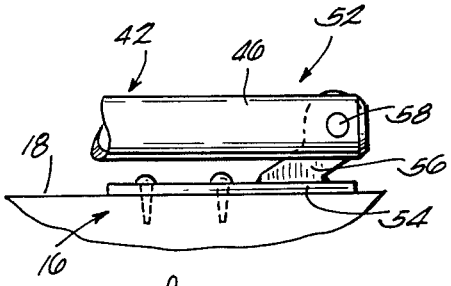
FIG. 4 is a view on line 4—4 of FIG. 1.

The boat 10 also includes an access ladder assembly 24. The assembly 24 comprises a ladder frame 26 including spaced, parallel side bars 28 and 30, and spaced, parallel rungs 32 extending between the side bars 28 and 30. The side bars 28 and 30 and the rungs 32 define a first plane 34. The ladder assembly 24 also comprises means for mounting the ladder frame 26 on the upper surf ac 18 of the transom platform 16 such that the ladder 26 frame is movable between a storage position (full lines in FIGS. 1–3) wherein the ladder frame 26 is located above the transom platform 16 and an operating position (dotted lines in FIGS. 1–3) wherein the ladder frame 26 extends below the transom platform 16 and overboard or into the water. Preferably, when the ladder frame 26 is in the storage position, the side bars 28 and 30 rest against the wall panel 22, out of the way of the access opening 14, and can be secured to the wall panel 22 by suitable locking means (not shown). When the ladder frame 26 is in the operating position, the side bars 28 and 30 rest against the rearward end 20 of the transom platform 16.

While various suitable mounting means can be employed, in the preferred embodiment, the mounting means includes a mounting frame 36 connected to the ladder frame 26 and defining a second plane 38 generally perpendicular to the first plane 34. In the illustrated construction, the mounting frame 36 includes a first leg member 40 having one end integrally connected to the first side bar 28, and an opposite or distal end adapted to be pivotally connected to the transom platform 16. Preferably, the first leg member 40 is disposed at an angle of approximately 45° relative to the first plane 34. The mounting frame 36 also includes a second leg member 42 having one end integrally connected to the second side bar 30, and an opposite or distal end adapted to be pivotally connected to the transom platform 16. More particularly, the second leg member 42 includes a first portion 44 connected to the second side bar 30 and extending generally perpendicular to the first plane 34, and a second portion 46 adapted to be pivotally connected to the transom platform 16 and extending generally parallel to the first leg member 40.

The means for mounting the ladder frame 26 also includes means for connecting the mounting frame 36 to the upper surface 18 of the transom platform 16 for pivotal movement relative thereto about a generally horizontal axis 48. Preferably, this means includes hinge means for pivotally connecting the distal ends of the leg members 40 and 42 to the transom platform 16. While various suitable hinge means can be employed, in the preferred embodiment, such means includes hinge apparatus 50 and 52 respectively connecting the leg members 40 and 42 to the transom platform 16. Each of the hinge apparatus 50 and 52 includes a plate 54 screwed or bolted to the transom platform 16 and carrying a vertical plate 56. The distal end of each of the leg members 40 and 42 is bifurcated and houses the vertical plate 56 of the associated hinge apparatus 50 or 52, and the leg member 40 or 42 is pivotally connected to the vertical plate 56 by a pivot pin 58.

The side bars 28 and 30 define a generally vertical storage plane 60 when the ladder frame 26 is in the storage position and define a generally vertical operating plane 62 when the ladder frame 26 is in the operating position. As shown in the drawings, the operating plane 62 is preferably generally perpendicular to the storage plane 60, and the pivot axis 48 is located in a generally vertical plane 64 bisecting the storage plane 60 and the operating plane 62.

Various features of the invention are set forth in the following claims.

I claim:

1. A marine installation comprising a watercraft having a generally horizontal surface, and a ladder assembly comprising a ladder frame including spaced, parallel side bars, and spaced, parallel rungs extending between said side bars, and means for mounting said ladder frame on said horizontal surface such that said ladder frame is movable between a storage position wherein said ladder frame is located above said sutface and said side bars define a generally vertical storage plane, an operating position wherein said ladder frame extends below said surface and said side bars define a generally vertical operating plane intersecting said storage plane.

2. A marine installation as set forth in claim 1 wherein said side bars and said rungs define a first plane, and wherein said mounting means includes a mounting frame connected to said ladder frame and defining a second plane generally perpendicular to said first plane, and means for connecting said mounting frame to said surface for pivotal movement relative thereto about a generally horizontal axis.

3. A marine installation as set forth in claim 2 wherein said mounting frame includes a first leg member having one end connected to one of said side bars and an opposite end pivotably connected to said surface, and a second leg member having one end connected to the other of said side bars and an opposite end pivotably connected to said surface.

4. A marine installation as set forth in claim 3 wherein said first leg member is disposed at an angle of approximately 45 degrees relative to said first plane, and wherein said second leg member includes a first portion connected to said other of said side bars and extending generally perpendicular to said first plane, and a second portion generally parallel to said first leg member.

5. A marine installation as set forth in claim 1 wherein said operating plane is generally perpendicular to said storage plane.

6. A marine installation as set forth in claim 5 wherein said mounting means includes means for connecting said ladder frame to said surface for pivotal movement relative thereto about a generally horizontal axis located in a generally vertical plane bisecting said storage and operating planes.

7. A marine installation comprising a watercraft having a generally horizontal surface, and a ladder assembly comprising a ladder frame including spaced, parallel side bars, and spaced, parallel rungs extending between said side bars, said side bars and said rungs defining a first plane, and means for mounting said ladder frame on said horizontal surface such that said ladder frame is movable between a storage position wherein said ladder frame is located above said surface and an operating position wherein said ladder frame extends below said surface, said mounting means including a mounting frame connected to said ladder frame and defining a second plane generally perpendicular to said first plane, said mounting frame including a first leg member disposed at an angle of approximately 45 degrees relative to said first plane and having one end connected to one of said side bars and an opposite end pivotably connected to said surface, and a second leg member having one end connected to the other of said side bars and an opposite end pivotably connected to said surface, said second leg member including a first portion connected to said other of said side bars and extending generally perpendicular to said first plane, and a second portion generally parallel to said first leg member.

8. A marine installation as set forth in claim 7 wherein said side bars define a generally vertical storage plane when said ladder frame is in said storage position, and wherein said side bars define a generally vertical operating plane when said ladder frame is in said operating position, said operating plane intersecting said storage plane.

9. A marine installation as set forth in claim 8 wherein said operating plane is generally perpendicular to said storage plane.

10. A marine installation as set forth in claim 9 wherein said opposite ends of said first and second leg members are connected to said surface for pivotal movement relative thereto about a generally horizontal axis located in a generally vertical plane bisecting said storage and operating planes.

11. An access ladder assembly for a watercraft having a generally horizontal surface, said assembly comprising a ladder frame including spaced, parallel side bars, and spaced, parallel rungs extending between said side bars, and means for mounting said ladder frame on the horizontal surface such that said ladder frame is movable between a storage position wherein said ladder frame is located above the surface and said side bars define a generally vertical storage plane, and an operating position wherein said ladder frame extends below the surface and said side bars define a generally vertical operating plane intersecting said storage plane.

12. A ladder assembly as set forth in claim 11 wherein said side bars and said rungs define a first plane, and wherein said mounting means includes a mounting frame connected to said ladder frame and defining a second plane generally perpendicular to said first pane, and means for connecting said mounting frame to the surface for pivotal movement relative thereto about a generally horizontal axis.

13. A ladder assembly as set forth in claim 12 wherein said mounting frame includes a first leg member having one end connected to one of said side bars and an opposite end adapted to be pivotably connected to the surface, and a second leg member having one end connected to the other of said side bars and an opposite end adapted to be pivotably connected to the surface.

14. A ladder assembly as set forth in claim 13 wherein said first leg member is disposed at an angle of approximately 45 degrees relative to said first plane, and wherein said second leg member includes a first portion connected to said other of said side bars and extending generally perpendicular to said first plane, and a second portion generally parallel to said first leg member.

15. A ladder assembly as set forth in claim 11 wherein said operating plane is generally perpendicular to said storage plane.

16. A ladder assembly as set forth in claim 15 wherein said mounting means includes means for connecting said ladder frame to the surface for pivotal movement relative thereto about a generally horizontal axis located in a generally vertical plane bisecting said storage and operating planes.

17. An access ladder assembly for a watercraft having a generally horizontal surface, said ladder assembly comprising a ladder frame including spaced, parallel side bars, and spaced, parallel rungs extending between said side bars, said side bars and said rungs defining a first plane, and means for mounting said ladder frame on the horizontal surface such that said ladder frame is movable between a storage position wherein said ladder frame is located above the surface and an operating position wherein said ladder frame extends below the surface, said mounting means including a mounting frame connected to said ladder frame and defining a second plane generally perpendicular to said first plane, said mounting frame including a first leg member disposed at an angle of approximately 45 degrees relative to said first plane and having one end connected to one of said side bars and an opposite end adapted to be pivotably connected to the surface, and a second leg member having one end connected to the other of said side bars and an opposite end adapted to be pivotably connected to the surface, said second leg member including a first portion connected to said other of said side bars and extending generally perpendicular to said first plane, and a second portion generally parallel to said first leg member.

18. An assembly as set forth in claim 17 wherein said side bars define a generally vertical storage plane when said ladder frame is in said storage position, and wherein said side bars define a generally vertical operating plane when said ladder frame is in said operating position, said operating plane intersecting said storage plane.

19. An assembly as set forth in claim 18 wherein said operating plane is generally perpendicular to said storage plane.

20. An assembly as set forth in claim 19 wherein said opposite ends of said first and second leg members are adapted to be connected to the surface for pivotal movement relative thereto about a generally horizontal axis located in a generally vertical plane bisecting said storage and operating planes.

* * * * *